US006105952A

United States Patent [19]

Helmstädter et al.

[11] Patent Number: 6,105,952

[45] Date of Patent: Aug. 22, 2000

[54] STACKED-SHEET PREFEEDER

[75] Inventors: Maximilian Helmstädter, Villingen-Schwenningen; Josef Batzer, Stadtbergen; Karl Zimmermann, Augsburg, all of Germany

[73] Assignee: Bowe Systec AG, Augsburg, Germany

[21] Appl. No.: 09/051,010

[22] PCT Filed: Feb. 13, 1997

[86] PCT No.: PCT/EP97/00677

§ 371 Date: Mar. 31, 1998

§ 102(e) Date: Mar. 31, 1998

[87] PCT Pub. No.: WO97/30918

PCT Pub. Date: Aug. 28, 1997

[30] Foreign Application Priority Data

Feb. 23, 1996 [DE] Germany ..... 196 06 833

[51] Int. Cl.[7] ..... B65H 5/22

[52] U.S. Cl. ..... 271/3.02; 271/3.05; 271/10.07; 271/225; 271/35

[58] Field of Search ..... 271/3.03, 3.02, 271/3.05, 10.06, 10.07, 10.08, 225, 35

[56] References Cited

U.S. PATENT DOCUMENTS

| | | | |
|---|---|---|---|
| 3,339,705 | 9/1967 | Burkhardt et al. | 271/3.05 |
| 3,870,294 | 3/1975 | Donner | 271/35 |
| 4,456,237 | 6/1984 | Buddendeck | 271/3.05 |

FOREIGN PATENT DOCUMENTS

| | | | |
|---|---|---|---|
| 0 115 208 B1 | 11/1987 | European Pat. Off. | B65H 3/06 |
| 404169474 | 6/1992 | Japan | 271/3.05 |
| 000682484A5 | 9/1993 | Switzerland | 271/3.05 |

*Primary Examiner*—H. Grant Skaggs
*Attorney, Agent, or Firm*—Wolf, Greenfield & Sacks, P.C.

[57] ABSTRACT

A stacked-sheet prefeeder comprises a sheet guiding device for receiving therein a stack of sheets, an intermediate tray, a scale former for removing sheets, arranged in a stack and/or in a scalelike mode of arrangement, jointly from the lower surface of the stack received in the sheet guiding device and for introducing these sheets into the intermediate tray in a first direction of movement, a sheet separator for removing from the intermediate tray the respective lowermost sheet as a single sheet in a second direction of movement which is substantially opposed to the first direction of movement, and a guide means arranged in the intermediate tray and used for guiding the sheets in the intermediate tray at their sheet edges constituting the front sheet edges in the second direction of movement, the guide means being implemented as a transport and guide means in such a way that it moves the sheet edges constituting the front sheet edges in the second direction of movement in the interior of the intermediate tray to the sheet separator.

4 Claims, 1 Drawing Sheet

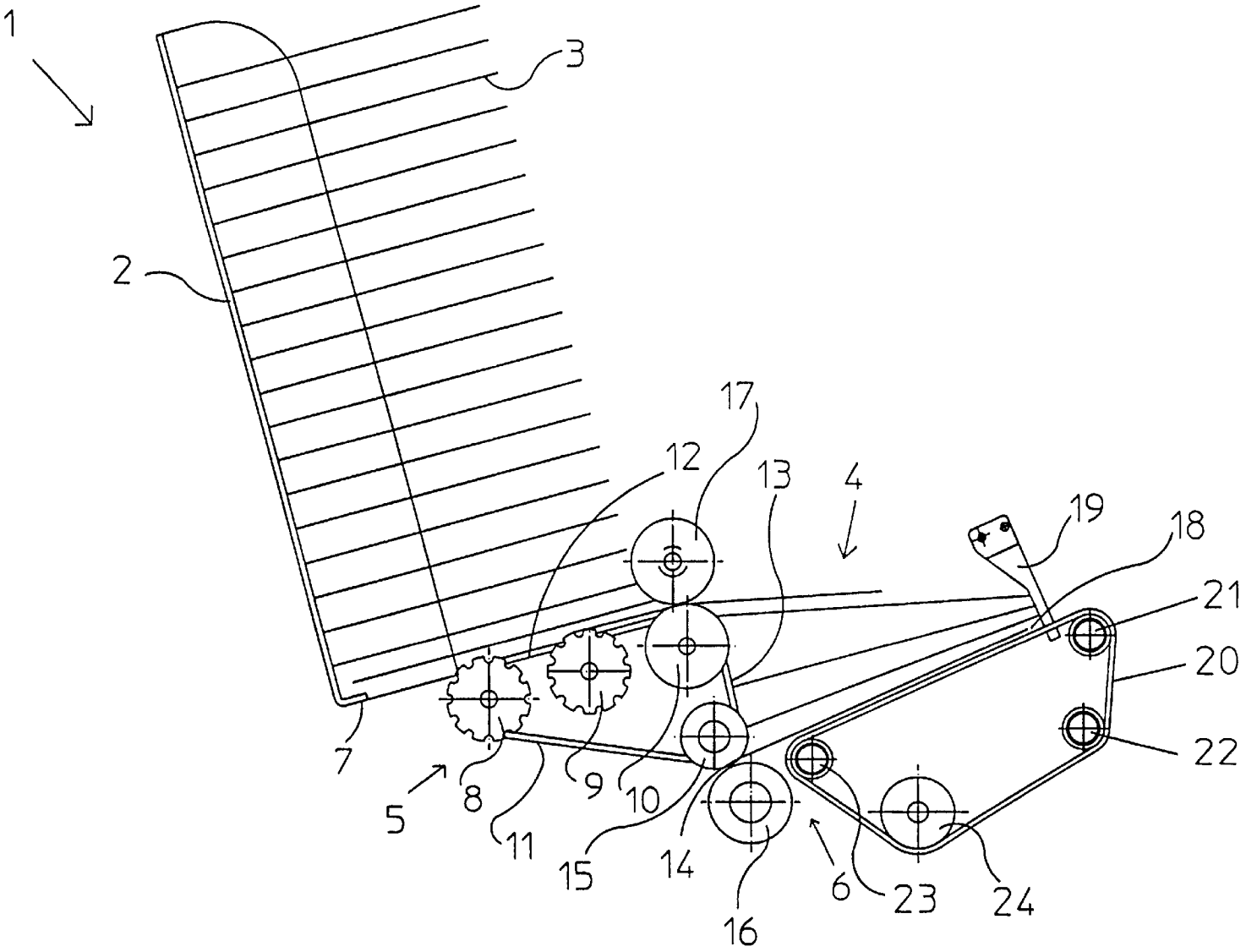
1
2
3
4
5
6
7
8
9
10
11
12
13
14
15
16
17
18
19
20
21
22
23
24

STACKED-SHEET PREFEEDER

BACKGROUND OF THE INVENTION

1. Field of the Invention

The present invention deals with a stacked-sheet prefeeder which removes, in a fish-scale-like mode of arrangement, a plurality of sheets from the bottom surface of a comparatively large stack of sheets and which separates these sheets subsequently.

2. Description of Prior Art

A known stacked-sheet prefeeder comprises a sheet guiding device for receiving therein a comparatively large stack of sheets, which, when seen in the direction of movement of the paper, is arranged behind an intermediate tray into which sheets are introduced which are removed from the lower surface of the stack in the form of a stack or in a scalelike mode of arrangement. In the known stacked-sheet prefeeder, individual sheets are removed from the bottom area of the intermediate tray for subsequent processing, the individual sheets being removed in the same direction of transport in which the scaled stream of sheets was introduced in the intermediate tray. It follows that in this known stacked-sheet prefeeder, which operates according to the stepwise separation principle explained hereinbefore, the stack of sheets is located behind the intermediate tray in the direction of movement of the paper or sheets of paper so that the scaled stream supplied to the intermediate tray and the stream of paper consisting of the separated sheets, which are removed from the intermediate tray, have the same direction of flow. In the known stacked-sheet prefeeder, the position of an active transport device, which removes the separated sheets from a bottom area of the intermediate tray, must be adjusted in dependence upon the format of the sheets. In other words, the transport device of the known stacked-sheet prefeeder must be readjusted in the direction of transport if the sheets become shorter in size. The adjustment operations, which are therefore required in the case of a change-over of the format processed by the stacked-sheet prefeeder, are complicated on the one hand and require a specially trained operator on the other.

German Patent 22 03 626 discloses an apparatus for removing sheets from a main stack, the apparatus comprising a removing device acting on the lower surface of the main stack, an arrangement for forming an intermediate stack of limited height, which is arranged subsequent to the removing device, and a second removing device acting on the lowermost sheet of the intermediate stack and followed by a separator device including at least two transport elements which act on the supplied sheet with different circumferential speeds as well as at least one brake means which acts on the supplied sheet from above. Furthermore, the main stack is inclined towards the intermediate stack, whereby the conveying plane of the first removing device defines an acute angle with the conveying plane of the second removing device, which extends on a lower level, a sensor switch controlling the first removing device being provided in the area of the intermediate stack for limiting the height of the intermediate stack. A stop means limiting the free movement of the sheets removed from the main stack is provided with the sensor switch. In addition, the direction of transport of the second removing device is opposite to the direction of transport of the first removing device.

SUMMARY OF THE INVENTION

Starting from this prior art, it is the object of the present invention to provide a stacked-sheet prefeeder which can be adjusted to process different sheet formats with little outlay.

This object is achieved by a stacked-sheet prefeeder having a sheet guiding device for receiving therein a stack of sheets, an intermediate tray, a scale former for removing sheets, arranged in a stack and/or in a scalelike mode of arrangement, jointly from the lower surface of the stack received in the sheet guiding device and for introducing these sheets into the intermediate tray in a first direction of movement, a sheet separator for removing from the intermediate tray the respective lowermost sheet as a single sheet in a second direction of movement which is substantially opposed to the first direction of movement, and a guide means arranged in the intermediate tray and used for guiding the sheets in the intermediate tray at their sheet edges constituting the front sheet edges in the second direction of movement, the guide means being implemented as a transport and guide means in such a way that it moves the sheet edges constituting the front sheet edges in the second direction of movement in the interior of the intermediate tray to the sheet separator.

The stacked-sheet prefeeder according to the present invention comprises a sheet guiding device for receiving therein a stack of sheets, an intermediate tray, a scale former for removing sheets, arranged in a stack or in a scalelike mode of arrangement, jointly from the lower surface of the stack received in the sheet guiding device and for introducing these sheets into the intermediate tray in a first direction of movement, and a sheet separator for removing from the intermediate tray the respective lowermost sheet as a single sheet in a second direction of movement which is substantially opposed to the first direction of movement.

In the case of the stacked-sheet prefeeder according to the present invention, the position of an active transport device used for transporting the separated sheets away can be maintained independently of the format of the sheets, when a change-over of the format of sheets has to be carried out. In accordance with a preferred embodiment, it is only necessary to readjust the position of a stop within the intermediate tray.

According to an important aspect of the present invention, a belt conveying section of a belt conveying means is provided in the interior of the intermediate tray, the sheet edges of the sheets in the intermediate tray constituting the front sheet edges in the second direction of movement abutting on the belt conveying section, whereby these sheet edges constituting the front sheet edges in the second direction of movement are forcibly guided up to the sheet separator, whereby an extremely reliable, congestion-free and fast operation of the stacked-sheet prefeeder is achieved.

BRIEF DESCRIPTION OF THE DRAWINGS

In the following, preferred embodiments of the stacked-sheet prefeeder according to the present invention are described in detail making reference to the drawing enclosed.

The only FIGURE shows a schematic side view of a preferred embodiment of a stacked-sheet prefeeder.

DESCRIPTION OF PREFERRED EMBODIMENTS OF THE INVENTION

A stacked-sheet prefeeder, designated generally by reference numeral 1 in the only FIGURE, comprises as main components a sheet guiding device 2 used for receiving therein a stack 3 of sheets, an intermediate tray 4, a scale former 5 for removing sheets, arranged in a stack or in a scalelike mode of arrangement, jointly from the lower surface of the stack 3 received in the sheet guiding device 2 and for introducing these sheets into the intermediate tray 4 in a first direction of movement, and a sheet separator 6 for removing from the intermediate tray 4 the respective lowermost sheet as a single sheet in a second direction of movement which is substantially opposed to the first direction of movement.

The scale former 5 comprises first, second and third feed rolls in the bottom area 7 of the sheet guiding device 2. The first feed roll 8 is located essentially centrally below the stack 3 so that most of the weight of the stack 3 rests thereon. Whereas the second and third feed rolls 9, 10 are driven substantially continuously when the stacked-sheet prefeeder is in operation, the drive of the first feed roll 8 can be switched off by means of a clutch (not shown) in response to a control which will be explained hereinbelow. A round belt 11, which is also driven by the third feed roll 10, comprises a first belt section 12 extending from the first to the third feed roll 8, 10 along the bottom area 7 of the sheet guiding device 2, and a second belt section 13 extending in the interior of the intermediate tray 4 from the driven third feed roll 10 at an oblique angle downwards up to a separation point 14 of the sheet separator 6. The separation point 14 is defined by an area of approach of a stationary separation roll 15 and a discharge roll 16, the rolls 15 and 16 being arranged at the separation point 14 at a distance from one another which is so small that the discharge roll 16 can never draw more than a single sheet through the nip between the discharge roll 16 and the separation roll 15.

A non-driven roll 17 is spring suspended above the third feed roll 10 such that it is movable in the vertical direction. The vertical position of the roll 17 is detected by a sensor (not shown), which responds when a maximum value of the thickness of the scaled stream moving between the roll 17 and the third feed roll 10 is exceeded, whereupon the feed roll 8 is stopped by opening the clutch of the feed roll 8. In this condition of rest of the first feed roll 8, the second and third feed rolls 9, 10 as well as the round belt 11 continue to rotate, whereby the scale distances of the scaled stream supplied to the intermediate tray 4 are enlarged; this has the effect that the scaled stream lengthens until the thickness of the scaled stream detected by the roll 17 has been reduced to a desired target value; when the target value is detected, the sensor reengages the clutch of the first feed roll 8, whereby the feed roll 8 is caused to rotate again.

At the side of the intermediate tray 4 located opposite the second belt section 13 of the round belt 11, a stop 19 is provided whose position can be adjusted parallel to a bottom area 18 of the intermediate tray in dependence upon the format of the sheets processed by the stacked-sheet prefeeder The bottom area 18 of the intermediate tray 4 is arranged such that it slopes downwards towards the separation point 14, whereby the sheets contained in the intermediate tray 4 abut on the second belt section 13 of the round belt 11 with the sheet edge constituting the left hand-side sheet edge in the FIGURE.

In the bottom area 18 of the intermediate tray 4, a friction belt 20, which extends parallel to the bottom area, is guided over three guide pulleys 21 to 23 and a drive pulley 24, the friction belt 20 being driven such that the respective lowermost sheet resting thereon is displaced within the intermediate tray 4 towards the separation point 14.

What is claimed is:

1. A stacked-sheet pre-feeder, comprising:

a sheet guiding device for receiving therein a stack of sheets;

an intermediate tray;

a scale former for removing sheets, arranged in a stack and/or in a scalelike mode of arrangement, jointly from the lower surface of the stack received in said sheet guiding device and for introducing these sheets into the intermediate tray in a first direction of movement;

a sheet separator for removing from said intermediate tray the respective lowermost sheet as a single sheet in a second direction of movement which is substantially opposed to said first direction of movement; and a guide means arranged in said intermediate tray and used for guiding the sheets in said intermediate tray at their sheet edges constituting the front sheet edges in the second direction of movement, said guide means being implemented as a transport and guide means in such a way that it moves the sheet edges constituting the front sheet edges in the second direction of movement in the interior of said intermediate tray to said sheet separator, wherein said scale former comprises a belt conveying means including a belt conveying section which extends from said scale former to the sheet separator in the interior of said intermediate tray and which defines the guide means for guiding the sheet edges of the sheets constituting the front sheet edges in the second direction of movement.

2. A stacked-sheet prefeeder according to claim 1, wherein the intermediate tray is arranged such that it slopes downwards in the direction of the second direction of movement.

3. A stacked-sheet prefeeder according to claim 1, comprising a friction belt means extending along the bottom area of the intermediate tray towards the sheet separator.

4. A stacked-sheet prefeeder according to claim 1, comprising a stop which is arranged such that it is movable substantially parallel to the bottom of said intermediate tray.

* * * * *